United States Patent [19]

Muellner et al.

[11] Patent Number: 4,518,072

[45] Date of Patent: May 21, 1985

[54] CART CONVEYOR AND DISPENSER APPARATUS

[76] Inventors: James M. Muellner, 1777 Stillwater St., White Bear Lake, Minn. 55110; Eugene R. Pastien, 8230 Longlake Rd., Moundsview, Minn. 55432

[21] Appl. No.: 507,810

[22] Filed: Jun. 24, 1983

[51] Int. Cl.[3] ..... G07F 1/06

[52] U.S. Cl. ..... 194/4 D; 104/172 B

[58] Field of Search ..... 104/172 B, 172 R; 194/4 D; 198/728

[56] References Cited

U.S. PATENT DOCUMENTS

| | | | |
|---|---|---|---|
| 2,818,955 | 1/1958 | Stackhouse | 194/4 |
| 3,194,377 | 7/1965 | Fischbach et al. | 194/4 |
| 3,408,951 | 11/1968 | Heinicke et al. | 104/172 B |
| 3,719,151 | 3/1973 | Andersen | 104/172 B |
| 3,754,630 | 8/1973 | Gilker | 194/4 |
| 3,978,959 | 9/1976 | Muellner | 194/4 R |
| 4,305,335 | 12/1981 | Plugge | 104/172 B |

*Primary Examiner*—Robert R. Song

*Attorney, Agent, or Firm*—Merchant, Gould, Smith, Edell, Welter & Schmidt

[57] ABSTRACT

A cart conveyor and dispensing device (10) is a preferred embodiment of the invention and is described herein. The conveyor (10) includes means for propelling a cart (26) through the conveyor (10). The propelling means includes a continuous member that carries a member for releasably engaging the rotating portion of a cart wheel. In a preferred embodiment, a chain assembly (29) carries crosspieces (46) that engage the center wheel (52) of the cart (26). If the cart is precluded from progressing through the conveyor (10), the chain assembly (29) continues to move with the crosspieces (46) rolling past the center wheel (52) without damaging the cart (26). A plurality of conveyor sections can be interconnected to create, for example, a three-conveyor system (91) that may accommodate more carts (26) and presents a return end (12) at a locus more conducive to return of carts (26) for the appropriate rewards.

40 Claims, 7 Drawing Figures

FIG. 1
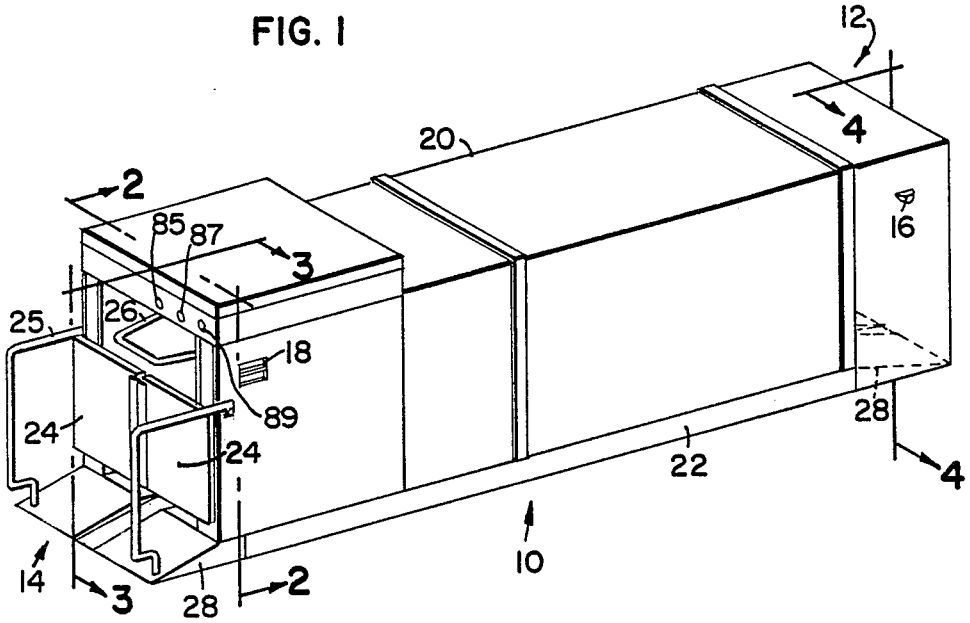
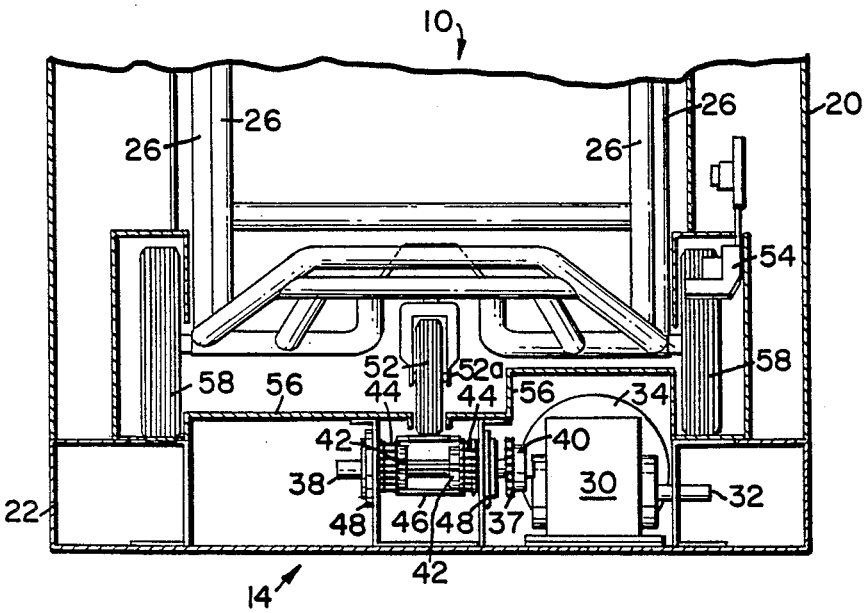
FIG. 2

CART CONVEYOR AND DISPENSER APPARATUS

FIELD OF THE INVENTION

The invention of the present application relates generally to the field of cart conveyors and more particularly to cart conveyors and dispensers that typically function in the following way: An individual who desires a cart inserts a token or sum of money into the machine and receives a cart, and when the cart is returned to a machine of similar design the individual receives a reward.

BACKGROUND OF THE INVENTION

Wheeled carts are useful in several different settings, including airports, grocery stores and retail shopping malls. The proprietors of such establishments often provide a plurality of carts for the convenience of their patrons. For example, carts are provided in airport terminals so that departing and arriving passengers may more easily transport their luggage, carry-on items and, in some cases, small children. The remainder of this application will primarily discuss an airport terminal application of the present invention, though clearly the invention may be used in connection with any facility where a plurality of carts are periodically needed by patrons.

Continuing the airport example, one long-standing problem with providing carts for passengers is that the carts are not properly returned to the place from which they were taken so that a maldistribution of carts results. That is, carts are typically used to haul luggage, etc. to the passengers' cars and then abandoned, resulting in an abundance of carts in the parking area and a deficiency of carts in the terminal where they are most needed. Generally, this is due to the passengers' negligence and the carts are not stolen or otherwise harmed, though cart damage and theft sometimes occur. At least two approaches to solving the problem discussed above have been utilized. The obvious approach, using employees to gather loose carts, tends to be menial work, is expensive and takes the employees away from more important tasks.

A better approach to the cart maldistribution problem discussed above has been proposed in the prior art. This approach generally works in the following way: An individual deposits a monetary sum, e.g., one dollar, into a cart dispenser and in return receives a single cart. Once the individual has used the cart, the cart may be returned to a cart dispenser, either the original cart dispenser or a similar dispenser, and a reward, e.g. twenty-five cents, is discharged by the machine in exchange therefore.

The prior art includes two patents directed to such cart dispensers: U.S. Pat. Nos. 3,194,377, issued to J. T. Fishbach et al, and 3,978,959, issued to J. M. Muellner, the latter assigned to the assignee of the present application. Typically, dispensers of this type are placed in the airport terminal and in or near parking areas or taxi stands, and users of the carts indeed tend to return the carts to dispensers in exchange for rewards. The problem of cart maldistribution persists, however, since most of the carts are taken from dispensers within the terminal and returned, if at all, to dispensers located in areas outside of the terminal. Excess carts in parking areas is potentially even more problematical in grocery store and shopping mall parking lots since the patrons have little need for hauling items into the establishment, and carts are rarely moved from the parking area to the interior of the establishment by the patrons.

The invention of the present application is directed to this problem. Particularly, the invention is a cart dispenser and storage device that includes a means for conveying carts from a receiving end, where a reward is preferably discharged or escrow returned upon return of a cart, to a rental end where the carts may be taken following the insertion of a sum of money or a token into a means for accepting same. The conveying means are motorized and preferably operate automatically to propel the carts to the rental end, eliminating the time and money consuming task of gathering carts in regions distant from the rental area. The carts are securely stored within the rental end of the device until dispensed to a paying patron.

It should be noted that the Fishbach patent also teaches a cart conveyor and storage device. The Fishbach device, though generally useful, includes at least two shortcomings, however. The Fishbach device is not suited for solving the aforementioned maldistribution problem. Fishbach, like Muellner, teaches a fairly short dispenser that is not designed to present a receiving end proximate to the area where the carts are unloaded. That is, Fishbach and Muellner are dispensers of the type that do dispense rewards for return of carts but do not significantly lessen the maldistribution problem by propelling the carts from unloading points to the rental area.

Fishbach also suffers from another disadvantage as compared to the present invention. In Fishbach, the conveyor includes hook-like members that engage the axles of carts. The hook-like members are attached to a chain, for example, which moves continuously. The members are counterweighted to disengage from the cart when the cart nests with similar carts near the rental end of the device. The Fishbach hook-like members present at least three problems. First, the hooks engage the carts themselves, resulting potentially in surface damage to the cart at the locus of the contact between hook and cart. Secondly, if the hook-like members fail to disengage from the carts or resist disengagement considerably, the carts can suffer more than mere surface damage, perhaps bending the carts' axles in extreme cases. Thirdly, if the Fishbach members are not counterweighted properly or otherwise are too "compliant" the carts may not be propelled at all.

SUMMARY OF THE INVENTION

The present invention solves the aforementioned problems by conveying a cart through cooperative contact between a motorized and movable portion of the dispenser and the driven wheel or wheels of the cart. If the cart nests with similar carts or otherwise experiences significant resistance to forward motion, the conveying chain assembly, for example, simply rolls past the driven wheels so that the carts are left unharmed. The present design clearly allows the portion of the conveyor in contact with the driven cart wheels to be fairly simple and in fact need not possess moving parts in contradistinction to the Fishbach device, resulting in less maintenance for carts and dispensers/conveyors and lower cost, as in a preferred embodiment of the present invention.

Additionally, the present invention includes means for lengthening the conveyor by inteconnecting a plurality of conveyor sections. This enables the "return"

end of the conveyor to be distant from the "rental" end of the conveyor so that the cart maldistribution problem is minimized.

BRIEF DESCRIPTION OF THE DRAWINGS

FIG. 1 is a perspective view of a preferred embodiment of the invention.

FIG. 2 is a front cross-sectional view of the embodiment shown in FIG. 1 taken along plane 2—2, showing the rental end of the apparatus.

DETAILED DESCRIPTION OF THE INVENTION

Figure 7:
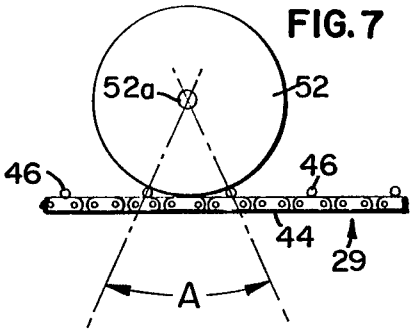
FIG. 7 is a diagrammatic view of a wheel of a cart nestled between a pair of crosspieces, showing a preferred angle A, the crosspieces being parts of the chain assembly of the embodiment shown in FIG. 1.

Referring now to the drawings wherein like reference numerals denote like elements throughout the several views, FIG. 1 is a perspective view of a preferred embodiment of the invention, indicated generally with the reference numeral 10. The device 10 is a cart conveyor and storage device having a return end, indicated generally with the reference numeral 12, and a rental end indicated generally with the reference numeral 14. The return end 12 includes a reward dispenser 16 whereas the rental end includes a money or token slot 18. The functions served by the reward dispenser 16 and money slot 18 are discussed below.

The cart dispenser and storage device 10 further includes a top cover 20 preferably fabricated from light gauge stainless steel sheet stock over an angle iron frame, and a base section 22 similarly fabricated. The details of this fabrication are not an important aspect of the present invention, and in any event are fully appreciated by those ordinarily skilled in the art of metal fabrication. The top section 20 may be readily removed from the base section 22 to permit maintenance of the conveyor components as further illustrated and discussed below.

Also included in the conveyor 10 are a pair of doors 24 which are preferably hinged to the top section 20. When a cart 26 is pulled from the rental end 14 of the conveyor 10, the doors 24 are nudged open by the cart 26 and then automatically close once the cart has passed therethrough. A pair of hand rails 25 prevent the doors 24 from opening past a plane substantially perpendicular to a plane containing the doors 24 in their closed position. The doors are biased to a closed position as shown in FIG. 1, either by appropriate counterweighting or spring loading. Once the cart 26 has passed through the doors 24, it rolls down a ramp 28 to the ground surface. Another ramp 28 is found at the return end 12 and assists in returning carts 26 in exchange for a reward as further discussed below.

FIG. 2 is a front cross-sectional view of the rental end 14 of the cart conveyor and storage device 10. The cart 26 illustrated in FIG. 2 and in the other figures is similar to the baggage cart as shown in U.S. Pat. No. D-206,116, issued to James R. Hughes on Nov. 1, 1966. Another cart style that could equally well be accommodated by the embodiment 10 is shown in U.S. Pat. No. D-230,142, issued to James M. Muellner. In general, each of the carts 26 has a chassis carried by means of a plurality of support wheels. The carts 26 illustrated in the appended figures are three-wheeled vehicles each having a pair of axially aligned support wheels 58 and having a third pivotal-type central support wheel 52. AS illustrated, the support wheels 58 normally engage the top surface of a cover 56 that is further supported by the base section 22. On the other hand, the center wheel 52 is supported and carried by a chain assembly 29 as further discussed below. It should be noted that the present invention is not limited to carts having three wheels. In fact, carts being supported by any number of rotating members could be conveyed and stored by an embodiment of the invention.

The motorized cart conveyor and storage device 10 as illustrated in FIG. 2 further includes an electric motor 34 which is directly coupled to a right hand drive and gear box 30. A gear box shaft 32, having a gear box chain sprocket 36 (shown in FIG. 3) is coupled via a drive chain 37 to a main drive sprocket 40 which is keyed to a drive shaft 38. The drive shaft 38 is supported by a pair of bearings 48 which are each mounted in a slidable bearing support 50 as shown in and discussed with reference to FIG. 3. Also attached to the drive shaft 38 are a pair of conveyor drive sprockets 42 which operatively engage the chain assembly 29 which carries the center wheel 52 and propels the cart 26 through the conveyor device 10.

The chain assembly 29 preferably comprises a pair of conveyor chains 44 of the roller chain type interconnected by a plurality of crosspieces 46. A longitudinal axis passes through each conveyor chain 44; the longitudinal axes of the conveyor chains 44 therefore are parallel throughout their lengths. It will be understood that the chain assembly 29 could be replaced by any flexible member, for example a flexible belt or cable. And, regardless of the form of the continuous flexible member, it contains a longitudinal axis in a manner similar to the axes of the conveyor chains 44 as discussed above. It should be further emphasized that preferably only the rolling portion of the center wheel 52 makes contact with the crosspieces 46 so that when the forward motion of the cart 26 is substantially impeded the roller chain assembly may continue to move and the crosspieces simply roll beneath the center wheel 52.

The rental end 14 of the conveyor 10 also includes a release member 54 which prevents the passage of a cart until a monetary sum of the proper amount or token is inserted in the money slot 18. U.S. Pat. No. 3,978,959, issued to James M. Muellner, describes a release mechanism, including release member, that will function in the device 10. Other release mechanisms of that general nature will also function adequately. It should be noted that the device 10 is designed so that preferably a plurality of carts 26 can be nested in the rental end 14 of the device 10 so that they are available for immediate use by patrons of the facility.

Figure 4:
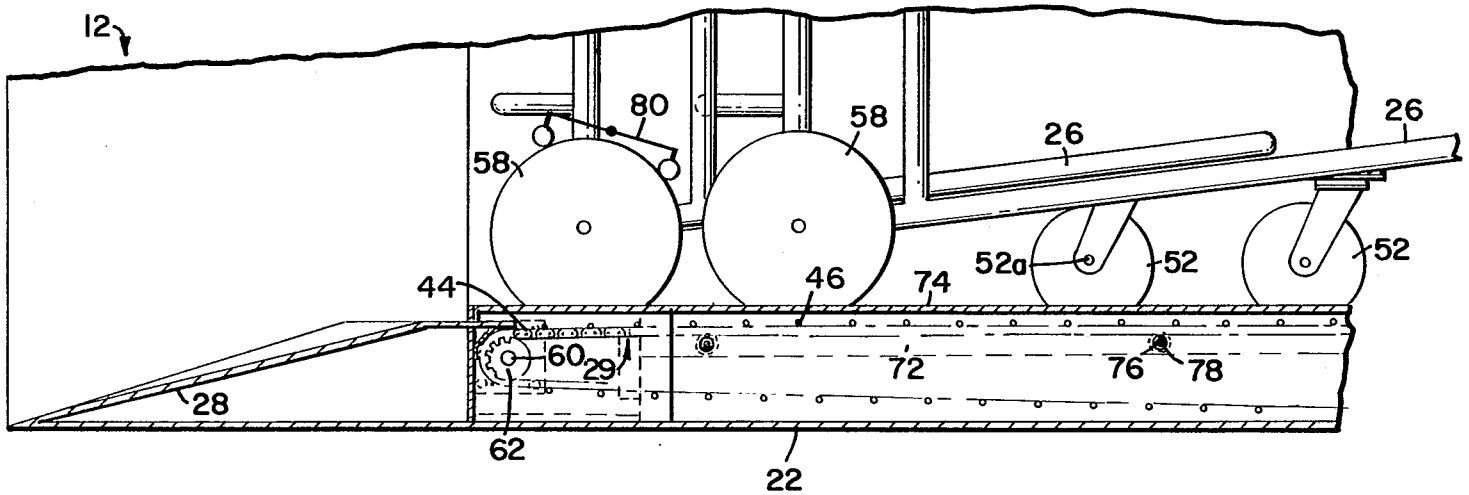
FIG. 4 is a side cross-sectional view of the return end of the embodiment shown in FIG. 1, taken along plane 4—4.
Figure 5:
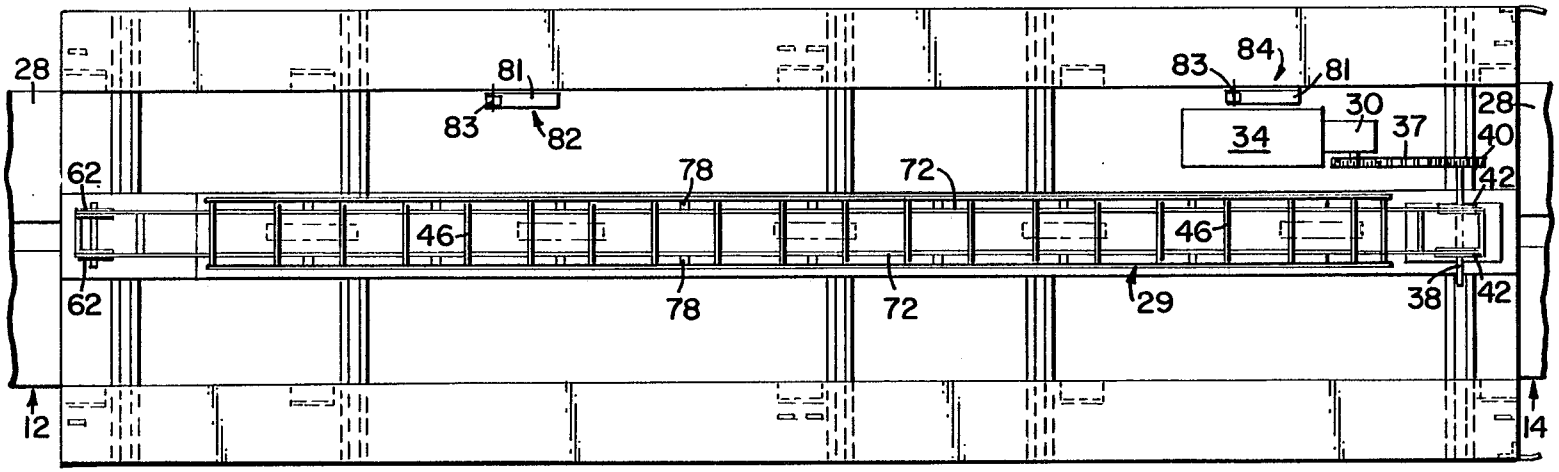
FIG. 5 is a top plane view of the embodiment shown in FIG. 1 with the top cover removed.
Figure 6:
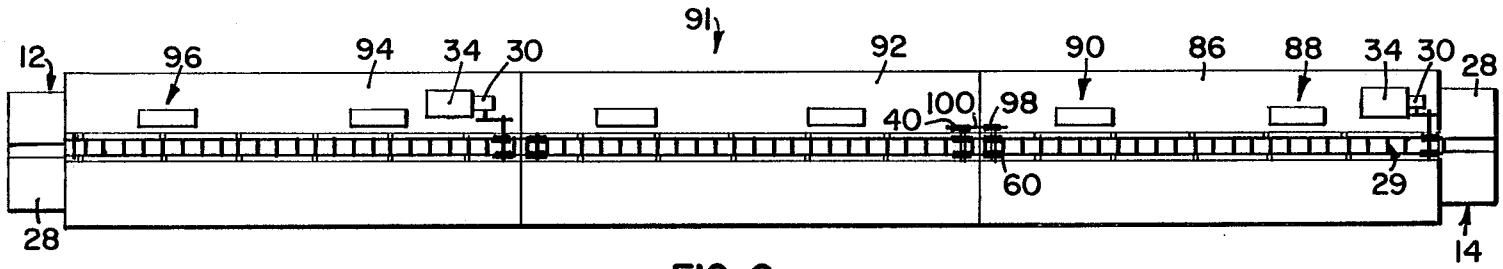
FIG. 6 is a diagrammatic top plan view of three conveyor sections coupled together, each section with its top cover removed and each similar to the embodiment shown in FIG. 1, with the center section of the device slaved off of the rental section.

Not shown in FIG. 2, though discussed below with reference to FIGS. 4 through 6, are conveyor idler sprockets 62 mounted on an idler shaft 60 which rotatably support the chain assembly 29 at a point distant from the rental end 14 of the device.

Figure 3:
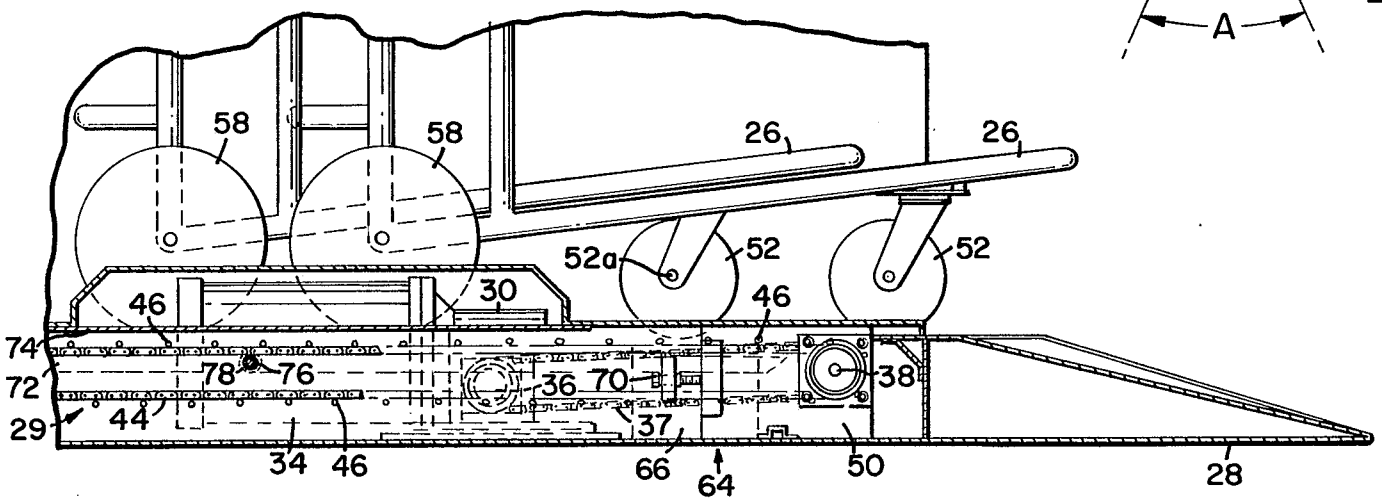
FIG. 3 is a side cross-sectional view of the rental end of the embodiment shown in FIG. 1, taken along plane 3—3.

FIG. 3 is a side cross-sectional view of the rental end 14 of the device 10. The motor 34 can be seen in this view along with the gear box 30 and gear box sprocket 36. Further, the drive chain 37 can be seen connecting the gear box sprocket 36 to the main drive sprocket 40 (FIG. 5) keyed to the drive shaft 38. Also shown is a chain tensioning device 64 including a stationary portion 66 and sliding portion that comprises the bearing support 50. Clockwise rotation of a chain tension bolt 70, having right hand threads, causes the bearing support 50 to move away from the gear box shaft 32 so that the drive chain 37 and conveyor chains 44 are tightened.

The ramp 28 can be seen in cross section in FIG. 3 and it shows that a central portion of the ramp 28 is indented so that the center wheel 52 of the cart 26 drops to a level below the support wheels 58 to better decouple the formerly nested carts 26. The ramp 28 is preferably formed from stainless steel sheet stock.

FIG. 3 also shows a chain rail 72 supported by a cover support 74. There are preferably a pair of chain rails 72, each chain rail 72 supporting one of the conveyor chains 44 of the chain assembly 29. The chain rails 72 are preferably made of a bar stock having a thickness that allows the rollers of the conveyor chains 44 to freely ride thereon. The chain rails 72 are preferably bolted to the cover support 74 with a plurality of rail bolts 76 and spaced therefrom with a corresponding plurality of tubular spacers 78. The rail bolts 76 and tubular spacers 78 are positioned with respect to the width of the chain rail 72 so that they do not interfere with the rolling of the conveying chains 44 on the chain rails 72. The chain rails 72 extend substantially the entire length of the conveyor section as illustrated in FIGS. 1 through 5.

As shown, there is preferably a plurality of crosspieces 46 mounted to the conveyor chains 44. For the sake of clarity, only the crosspieces 46 are shown in FIG. 3, though it is understood that the crosspieces 46 are attached to conveyor chains 44 which are carried by chain rails 72. The crosspieces 46 are preferably substantially slender members that are aligned so that their longitudinal axes are approximately perpendicular to the chains' longitudinal axes. L-shaped tabs (not shown) welded to the chain links preferably support the crosspieces 46, and the crosspieces 46 are preferably stamped and have a circular cross section proximate to the wheel of the cart that is being transported by the conveyor 10. The invention contemplates that the crosspieces 46 could also be weldments, and in fact could be fabricated by any well-known technique. Crosspieces 46 support and convey the center wheel 52 of a cart 26 as it is being propelled through the conveyor 10. Thus, the crosspieces 46 are preferably spaced sufficiently far apart so that the center wheel 52 is securely nestled between a pair of crosspieces 46. On the other hand, the crosspieces 46 should not be spaced so far apart that the center wheel 52 of a cart 26 is so securely wedged therebetween that a very large frontal impact on the cart 26 is required to roll the center wheel 52 out of engagement with the pair of crosspieces 46. It has been found that for a five inch outside diameter center wheel 52 that approximately two inches between the centerlines of crosspieces 46 is preferable, particularly when a 40-pitch chain is utilized. With the center wheel 52 nestled between a pair of crosspieces 46, this results in an angle between the crosspieces 46, with the center **52*a* of the center wheel 52 being the common point of lines extending through the center 52*a* and the points of contact of the crosspieces 46 with the center wheel 52, of approximately 48°. This angle is designated in FIG. 7 as A. It will be understood that if the crosspieces 46 have a different size or shape, the two inch distance mentioned above and the 48° relationship may vary. In fact, the angle A may range from thirty to ninety degrees in a given embodiment of the invention, depending on the size of the center wheel 52, the nature of the crosspieces 46, and the angle of ascent of the device 10 and the weight of the cart 26**, perhaps among other factors. The angle A may extend beyond the specified range in particular circumstances and in such cases would still be encompassed by the invention.

The invention contemplates that the center wheel 52 is nestled between a pair of crosspieces 46. It may also be that the center wheel 52 is simply periodically impacted by a crosspiece 46 and thereby propelled down and through the conveyor 10. It is simply important that the crosspieces 46 make contact with the center wheel 52 and not with any other portion of the cart 26 so that when the cart 26 is substantially impeded from moving in a forward direction the chain assembly 29 may continue to move without damaging the cart 26.

It should be noted that the invention is not limited to a roller chain assembly. As mentioned above, flexible belts and cables having appropriate extensions corresponding to the crosspieces 46 are contemplated by the invention. Also, the invention is not limited to applying mechanical power to the center wheel 52; power could be applied to any number of wheels on any type of wheeled carts without departing from the spirit of the invention.

FIG. 4 shows a side cross-sectional view of the return end 12 of the conveyor 10. Carts 26 are preferably rolled up the ramp 28 with their center wheels 52 leading the support wheels 58. Preferably, one of the support wheels 58 engages a receiver apparatus 80 as described in detail in U.S. Pat. No. 3,978,959, issued to J. M. Muellner. The receiver apparatus 80 is positioned to engage one of the support wheels 58 and the receiver apparatus 80 has a reward unit operatively connected therewith which dispenses a reward to the reward dispenser 16, shown in FIG. 1. Mounting of the receiver apparatus 80 within the device 10 is not a critical part of the invention, but would generally be mounted in a fashion similar to the release member 54. The chain assembly 29 is supported by a pair of chain rails 72 and engaged by conveyor idler sprockets 62 which are fixedly connected to the idler shaft 60. Thus it can be seen that the chain assembly 29 is "endless" and turns about conveyor drive sprockets 42, shown in FIG. 3, and idler sprockets 62, shown in FIG. 4. Between the sprockets 42 and 62 are the chain rails 72 which provide linear support to the conveyor chains 44. Again, to make FIG. 4 more clear the conveyor chain 44 is not shown the entire length of the chain rails 72.

FIG. 5 a top plan view of the conveyor 10 with the top cover 20 removed, and it also shows the chain assembly 29 as driven by the conveyor drive sprockets 42 and supported by the chain rails 72 and idler sprockets 62. The motor 34 is shown coupled to the gear box 30. As discussed above, a drive chain 37 runs from the gear box sprocket 36 to the main drive sprocket 40 on the drive shaft 38. Mechanical power derived from the drive shaft 38 is used to drive the chain assembly 29 which propels the carts 26 through the conveyor 10.

Also shown in FIG. 5 is a rear limit switch 82 and a front limit switch 84. The limit switches 82 and 84 each preferably comprises a lever arm 81 that is pinned to a post 83. The lever arms 81 are configured to make contact with the support wheels 58 of carts 26 as the carts traverse the conveyor 10. The lever arms 81 are preferably in contact with electrical switches which change states when the lever arms 81 are tripped. Such a limit switch configuration is very well known in many arts, including control system design. The significance and operation of limit switches 82 and 84 will be further discussed below with reference to FIG. 6.

It can also be seen in FIG. 5 that the chain rails 72 are in a spaced relationship with the cover support 74 due to the tubular spacers 78.

The operation of the conveyor 10 can now be described with reference to FIGS. 1 through 5. If a cart 26 is available for dispensing by the conveyor 10, as indicated by, for example, the illumination of an "Insert Dollar" light 85 as shown in FIG. 1, the patron may insert the proper monetary sum into the money slot 18 which sets the conveyor 10 into operation. As described in U.S. Pat. No. 3,978,959, the money is validated by a money validator (not shown) and the release member 54 is unlocked to allow the patron to pull the cart 26 from the rental end 14 of the device 10. The release member 54 may be unlocked either manually, using mechanical power supplied by the patron, or automatically, using a vend motor (not shown). The vend motor would typically be actuated by a relay (not shown) energized by a signal generated by the money validator (not shown). A "Remove Cart" light 87, shown in FIG. 1, is energized to indicate to the patron that a cart 26 may be removed. As the cart 26 shifts the release member 54, a release member limit switch (not shown) changes from a first state to second state which, typically by deenergizing a relay (not shown), causes the motor 34 to begin running which drives the chain assembly 29, driving any remaining carts 26 toward the rental end 14 of the conveyor 10. If a cart 26 does not energize rear limit switch 82 or front limit switch 84 within a predetermined length of time, as timed by a time delay relay or solid state timer (not shown), an "Out of Carts" light 89, shown in FIG. 1, is turned on indicating to the patron that the prescribed monetary sum should not be inserted into the money slot 18. If a cart 26 is subsequently inserted at the return end 12, and once the receiver apparatus 80 has accepted the cart 26, the patron will receive a reward at reward dispenser 16, as described in U.S. Pat. No. 3,978,959. The returned cart 26 will then ultimately be conveyed toward the rental end 14 of the conveyor 10 eventually contacting the lever arm 81 of the front limit switch 84 which enables the bill validator (not shown). The cart 26 is then available for rental. If at any time during the conveying process the cart 26 is prevented from moving forward, for example when the carts 26 become nested near the rental end 14 of the conveyor 10, the chain assembly 29 may continue to move without damaging the carts 26. The crosspieces 46 simply roll beneath center wheel 52, causing the carts 26 to bob gently with the passing of each crosspiece 46.

It should be emphasized that a control system (not shown), including relays, timers and other components, that would energize the motor 34, indicator lights 85, 87 and 89 and release member 54 could be easily fabricated in any number of ways that are all well-known in the art of control systems design.

FIG. 6 is a diagrammatic top plan view of three conveyor sections coupled together into a three-conveyor system 91, each section with its top cover removed. A front section 86 includes a motor 34 and chain assembly 29, just as did the conveyor 10 as discussed above. Also, the front section 86 includes a rental end 14 that is substantially similar to the rental end 14 of the conveyor 10. However, the front section 86 does not include a ramp 28 at a return end 12 as did the conveyor 10. Instead, the rear end of the front section 86 is coupled to a middle section 92. The idler shaft 60 of the front section 86 includes a slave drive sprocket 98 that drives a slave chain 100 interconnecting the slave drive sprocket 98 with the main drive sprocket 40 of the middle section 92. Thus, the middle section 92 is "slaved" off of the front section 86. That is, the chain assembly 29 of the middle section 92 is driven when the chain assembly 29 of the front section 86 is driven by the motor 34 in the front section 86. The motor 34 must therefore supply enough mechanical power to drive two conveyor sections 86 and 92. Connected to the rear end of the middle section 92 is a rear section 94. At the rear end of the rear section 94 is a return end 12 for the three conveyor section assembly 91. The return end 12 of this assembly 91 operates substantially the same as the return end 12 of the conveyor 10 discussed above. Further, the rear section 94 is independently driven by its own motor 34.

The front section 86 includes a first limit switch 88 that corresponds to the front limit switch 84 in the conveyor 10 as discussed above. The front section 86 also includes a second limit switch 90 corresponding to rear limit switch 82 of the conveyor 10. A third limit switch 96 is located in the rear section 94 and is positioned in the rear section 94 in a manner similar to the positioning of the second limit switch 90 and the rear limit switch 82 discussed above.

The operation of the three conveyor embodiment 91 outlined above can now be described. If the "Insert Dollar" light 85 is on, the patron inserts a dollar into the money slot 18. Once the dollar is validated and counted, the release member 54 is unlocked and the "Remove Cart" light 87 is energized and a cart 26 can be removed from the rental end 14 of the system 91. Once the cart 26 is removed, a release member limit switch (not shown) switches states which, through electrical components not illustrated but typically comprising a relay (not shown), causes the motor 34 of the front section 86 to drive the chain assembly 29 of the front section 86 and the middle section 92. If a cart 26 does not reach either the first limit switch 88 or the second limit switch 90 within a predetermined length of time as timed by a time delay relay or solid state timer (not shown), the motor 34 of the rear section 94 is energized, typically by a relay (not shown) to cause any cart 26 in the rear section 94 to proceed to the middle section 92. Until a cart 26 is available for dispensing to a patron at the rental end 14, the "Out of Carts" light 89 will remain energized. The third limit switch 96 will be energized when carts 26 are inserted into the return end 12 and will signal the three conveyor system 91 to propel the inserted cart 26 to the rental end 14 so that a cart 26 will be available for rental as indicated by the "Insert Dollar" light 85 being turned on.

It should be noted that the electrical control system that receives the signals from the aforementioned limit switches and causes the motors 54 and lights 85, 87 and 89 to energize may be built using relay or solid state logic, for example. Such a design would be straight forward for one ordinarily skilled in the art of controller design, and need not be discussed in detail.

Numerous characteristics and advantages of the invention have been set forth in the foregoing detailed description. It will be understood, of course, that this disclosure is in many respects only illustrative. Changes may be made in details, particularly in matters of shape, size, and arrangement of parts without exceeding the scope of the invention as defined in the appended claims.

I claim:

1. A conveyor for wheeled carts, the carts being of the type having a rotating member that is rotatably connected to the cart, said conveyor comprising:

(a) a continuous member having a periphery and a peripheral longitudinal axis lying therein;

(b) rotating means for operatively engaging said continuous member and rotating it about a plurality of drive axes, said drives axes being substantially parallel to each other; and (c) means for releasably engaging the rotating member, said engaging means being operatively connected to said continuous member, wherein said conveyor is configured for propelling the cart in a direction substantially parallel to said continuous member's peripheral longitudinal axis, and wherein said continuous member periphery and said engaging means are configured to move relative to and beneath the cart's rotating member when the cart's motion is substantially impeded.

2. The conveyor as recited in claim 1, wherein said continuous member comprises a roller chain.

3. The conveyor as recited in claim 2, wherein said rotating means comprises a plurality of chain sprockets suitable for operative engagement with said roller chain.

4. The conveyor as recited in claim 3, wherein said rotating means further comprises a motor operatively connected to one of said chain sprockets.

5. The conveyor as recited in claim 4, wherein said motor comprises an electric motor.

6. The conveyor as recited in claim 1, wherein said engaging means comprises a projection extending from and operatively connected to said continuous member.

7. The conveyor as recited in claim 1, wherein said continuous member comprises a plurality of roller chains, and wherein said projection spans across said plurality of said roller chains.

8. The conveyor as recited in claim 7, wherein said rotating means comprises a plurality of chain sprockets suitable for operative engagement with said roller chains.

9. The conveyor as recited in claim 8, wherein said rotating means further comprises an electric motor operatively connected to one of said chain sprockets.

10. The conveyor as recited in claim 9, wherein said engaging means comprises a crosspiece having a longitudinal axis operatively connected to each of said plurality of roller chains.

11. The conveyor as recited in claim 10, wherein said engaging means comprises a plurality of crosspieces, each of said crosspieces having a longitudinal axis and being operatively connected to each of said plurality of said roller chains, said crosspieces being spaced along the longitudinal axes of said roller chains wherein two of said crosspieces are in cooperative contact with the rotating member as the cart is being propelled in a direction substantially parallel to the longitudinal axes of said roller chains.

12. The conveyor as recited in claim 11, wherein the rotating member is a wheel.

13. The conveyor as recited in claim 12, wherein said crosspieces are adapted to be beneath a portion of the wheel and support the wheel of the cart when the cart is being propelled by said conveyor.

14. The conveyor as recited in claim 13, wherein the wheel has an axis about which it rotates, and an angle A between a first line through the wheel axis and a first crosspiece longitudinal axis and a second line through the wheel axis and a second crosspiece longitudinal axis, said angle A being between 30° and 90°, inclusively.

15. The conveyor as recited in claim 14, wherein said angle A is approximately 48°.

16. A conveyor for wheeled carts, the carts each having a wheel that is rotatably connected to the cart, said conveyor comprising:

(a) a plurality of roller chains, each of said roller chains having its ends interconnected to form a continuous chain and having a longitudinal axis, and said longitudinal axes being in parallel relationship with one another;

(b) a plurality of chain sprockets in operative engagement with said plurality of roller chains, said chain sprockets supporting and empowering said roller chains, and said chain sprockets adapted to be driven by an electric motor; and (c) a plurality of crosspieces adapted to engage the wheel of the cart, each of said crosspieces connected to said plurality of said roller chains and a longitudinal axis of each of said crosspieces being substantially perpendicular to said longitudinal axes of said roller chains, whereby the cart is propelled in a direction substantially parallel to said longitudinal axes of said roller chains and whereby said roller chains and said crosspieces move relative to the cart when the cart's motion is substantially impeded.

17. The conveyor as recited in claim 16, further comprising an electric motor in operative connection with one of said chain sprockets.

18. The conveyor as recited in claim 17, further comprising means for cooperating with a second conveyor of similar construction, whereby a cart is propelled from one conveyor to another.

19. A wheeled cart storage and dispensing device comprising:

(a) an elongated housing structure, guide means extending throughout said housing for guiding movement of carts through said housing, means disposed within said housing for conveying and positioning carts from one end to the other thereof to be available for dispensing, dispensing means at one end of said housing for discharging a single cart in response to deposit of a particular monetary sum, and means at the other end of said housing for receiving one cart at a time, and means connected to said cart receiving means for discharging a token, said means for conveying the carts including a continuous member having a periphery and a peripheral longitudinal axis lying therein;

(b) rotating means for operatively engaging said continuous member and rotating it about a plurality of drive axes, said drive axes being substantially parallel to each other; and (c) means for supporting and engaging a cart wheel, said supporting and engaging means being operatively connected to said continuous member, wherein said conveyor is configured for propelling the cart in a direction substantially parallel to said continuous member's peripheral longitudinal axis, and wherein said continuous member periphery and said engaging means are configured to move relative to and beneath the cart's rotating member when the cart's motion is substantially impeded.

20. A method for conveying a wheeled cart, the cart being of the type having a rotating member that is rotatably connected to the cart, comprising:

(a) selecting a continuous member having a periphery and a peripheral longitudinal axis lying therein;

(b) selecting rotating means for operatively engaging said continuous member and rotating it about a plurality of drive axes, said drive axes being substantially parallel to each other;

(c) selecting means for releasably engaging the rotating member, said engaging means being operatively connected to said continuous member, wherein said engaging means is configured for propelling the cart in a direction substantially parallel to said continuous member's peripheral longitudinal axis, and wherein said continuous member periphery and said engaging means are configured to move relative to and beneath the cart's rotating member when the cart's motion is substantially impeded; and (d) operatively engaging the cart's rotating member with said engaging means.

21. The cart conveying method as recited in claim 20, wherein said continuous member comprises a roller chain.

22. The cart conveying method as recited in claim 21, wherein said rotating means comprises a plurality of chain sprockets suitable for operative engagement with said roller chain.

23. The cart conveying method as recited in claim 22, wherein said rotating means further comprises a motor operatively connected to one of said chain sprockets.

24. The cart conveying method as recited in claim 23, wherein said motor comprises an electric motor.

25. The cart conveying method as recited in claim 20, wherein said engaging means comprises a projection extending from and operatively connected to said continuous member.

26. The cart conveying method as recited in claim 20, wherein said continuous member comprises a plurality of roller chains and wherein said projection spans across said plurality of said roller chains.

27. The cart conveying method as recited in claim 26, wherein said rotating means comprises a plurality of chain sprockets suitable for operative engagement with said roller chains.

28. The cart conveying method as recited in claim 27, wherein said rotating means further comprises an electric motor operatively connected to one of said chain sprockets.

29. A conveyor for wheeled carts, the carts being of the type having a rotating member that is rotatably connected to the cart, said conveyor comprising:

(a) a continuous member having a periphery and a peripheral longitudinal axis lying therein;

(b) rotating means for operatively engaging said continuous member and rotating it about a plurality of drive axes, said drive axes being substantially parallel to each other; and (c) means operatively connected to said continuous member for releasably engaging the rotating member comprising first and second longitudinally spaced projections, wherein said projections are spaced such that the rotating member nestles therebetween and is supported thereby when the cart is being conveyed by said conveyor; wherein said conveyor is configured for propelling the cart in a direction substantially parallel to said continuous member's peripheral longitudinal axis; and wherein said continuous member periphery and said first and second projections are configured to move relative to and beneath the cart's rotating member when the cart's motion is substantially impeded.

30. The conveyor as recited in claim 29, wherein said continuous member comprises a roller chain.

31. The conveyor as recited in claim 30, wherein said rotating means comprises a plurality of chain sprockets suitable for operative engagement with said roller chain.

32. The conveyor as recited in claim 31, wherein said rotating means further comprises a motor operatively connected to one of said chain sprockets.

33. The conveyor as recited in claim 32, wherein said motor comprises an electric motor.

34. The conveyor as recited in claim 29, wherein said continuous member comprises a plurality of roller chains, and wherein said projections span across said plurality of said roller chains.

35. The conveyor as recited in claim 34, wherein said rotating means comprises a plurality of chain sprockets suitable for operative engagement with said roller chains.

36. The conveyor as recited in claim 35, wherein said rotating means further comprises an electric motor operatively connected to one of said chain sprockets.

37. The conveyor as recited in claim 36, wherein said first and second projections comprise first and second crosspieces, respectively, each of said crosspieces having a longitudinal axis, wherein each of said crosspieces is operatively connected to each of said plurality of roller chains.

38. The conveyor as recited in claim 37, wherein the rotating member is a wheel.

39. The conveyor as recited in claim 38, wherein the wheel has an axis about which it rotates, and an angle A exists between a first line through the wheel axis and said first crosspiece longitudinal axis and a second line through the wheel axis and said second crosspiece longitudinal axis, said angle A being between 30° and 90°, inclusively.

40. The conveyor as recited in claim 39, wherein said angle A is approximately 48°.

* * * * *

UNITED STATES PATENT AND TRADEMARK OFFICE

CERTIFICATE OF CORRECTION

PATENT NO. : 4,518,072

DATED : May 21, 1985

INVENTOR(S) : James M.Muellner et al

It is certified that error appears in the above-identified patent and that said Letters Patent is hereby corrected as shown below:

On the title page insert;

--Assignee: Smarte Carte, Inc., White Bear Lake, Minn.--

Signed and Sealed this

*Twenty-ninth* Day of *April 1986*

[SEAL]

*Attest:*

DONALD J. QUIGG

*Attesting Officer*

*Commissioner of Patents and Trademarks*